United States Patent [19]

Seeney et al.

[11] 4,423,764

[45] Jan. 3, 1984

[54] BINDER FOR PREPARING IMPROVED CORES AND MOLDS

[75] Inventors: Charles E. Seeney, Brazil; John F. Kraemer; Janis Ingebrigtsen, both of Terre Haute, all of Ind.

[73] Assignee: International Minerals & Chemical Corp., Terre Haute, Ind.

[21] Appl. No.: 342,314

[22] Filed: Jan. 25, 1982

[51] Int. Cl.[3] ..... B22C 1/18

[52] U.S. Cl. ..... 164/528; 164/520

[58] Field of Search ..... 164/528, 529, 527, 521, 164/520; 106/38.3, 38.9

[56] References Cited

U.S. PATENT DOCUMENTS

| | | | |
|---|---|---|---|
| 2,479,504 | 8/1949 | Moore et al. | 106/38.3 |
| 2,895,838 | 7/1959 | Ilenda | 106/38.3 |
| 4,070,195 | 1/1978 | Toeniskoetter et al. | 106/38.3 |
| 4,078,599 | 3/1978 | Makiguchi et al. | 164/521 |
| 4,209,056 | 6/1980 | Gardikes et al. | 106/38.3 X |

FOREIGN PATENT DOCUMENTS

| | | | |
|---|---|---|---|
| 45-8844 | 3/1970 | Japan | 106/38.3 |
| 51-72922 | 6/1976 | Japan | 164/520 |
| 1435988 | 5/1976 | United Kingdom | 106/38.3 |
| 532452 | 12/1976 | U.S.S.R. | 164/520 |
| 538809 | 12/1976 | U.S.S.R. | 164/520 |

*Primary Examiner*—Kuang Y. Lin

*Attorney, Agent, or Firm*—Robert H. Dewey

[57] ABSTRACT

An improved binder for a foundry aggregate comprising aluminum dihydrogen phosphate in combination with ammonium polyphosphate, potassium polyphosphate, potassium olivine phosphate, volcanic ash, sodium silicate, phosphoric acid or mixtures thereof.

10 Claims, No Drawings

BINDER FOR PREPARING IMPROVED CORES AND MOLDS

BACKGROUND OF THE INVENTION

This invention relates to an improved process for preparing cores and molds used in the metal casting industry. In a particular aspect, this invention relates to an improved inorganic binder for foundry aggregates.

Binders for foundry aggregates used for making foundry cores and molds for metal castings are usually organic in nature, i.e. organic polymers and resins. These organic compounds are decomposed or volatilized when the molten metal contacts the core or mold and the resulting fumes and vapors cause a problem of air pollution. There is, therefore, a need to provide an all inorganic, non-volatile binder which is non-contaminating to the environment.

SUMMARY OF THE INVENTION

It is an object of this invention to provide an improved process for preparing cores and molds used in the metal casting industry.

It is another object of this invention to provide an improved, inorganic binder for foundry aggregates used in the preparation of cores and molds.

It is yet another object of this invention to provide a method for preparing cores and molds which does not contribute to air pollution in the work area.

Still other objects of this invention will be apparent to those skilled in the art from the disclosure herein.

It is the discovery of this invention to provide an improved binder and hardener therefor for forming cores and molds from foundary aggregate. The improved binder is aluminum dihydrogen phosphate, which is inorganic, non-volatile and hence non-polluting to the atmosphere. Preferably, but not necessarily, the aluminum dihydrogen phosphate is used in combination with a hardener such as volcanic ash, ammonium polyphosphate, potassium polyphosphate, potassium olivine phosphate, or phosphoric acid, or mixtures thereof.

DETAILED DISCUSSION

The amount of aluminum dihydrogen phosphate used in the practice of this invention is not critical. It is more economical, and hence more desirable, to use the minimum amount of binder consistent with satisfactory tensile strength. Generally about 1–3%, preferably about 3%, based on the weight of the aggregate, is sufficient. Preferably it is used in combination with a hardener, such as ammonium or potassium polyphosphate. When used in combination with potassium olivine phosphate it is generally mixed with phosphoric acid and 0.5–2% is generally sufficient. A preferred binder is aluminum dihydrogen phosphate in combination with ammonium polyphosphate in a ratio of about 3-4:1 by weight, respectively.

In a particularly preferred embodiment of this invention, 0.25% of volcanic ash, based on the weight of the aggregate, is used with the ammonium polyphosphate. Volcanic ash is typically composed of metal oxides and silicates. Preferred volcanic ash is that obtained from the Northwest United States region, e.g. ash from Mt. St. Helens. However, the composition of the ash is not critical and may vary widely without departing from the concept of this invention.

Another suitable component useful with the aluminum dihydrogen phosphate and ammonium polyphosphate is sodium silicate having about 50% sodium calculated as the oxide.

In the practice of this invention, it is convenient to first mix the aggregate with other dry ingredients, if any, then add the liquids, including phosphoric acid. Some of the ingredients can be used either as dry powder or as aqueous solutions. The latter are generally preferred. The mixture is well agitated to coat the aggregate which is then delivered to the mold or core box where it is allowed to cure about two hours, at which time the core or mold is removed and allowed to finish curing for a suitable length of time, e.g. overnight.

Aluminum dihydrogen phosphate is a known compound represented by the formula $Al(H_2PO_4)_3$. It is commercially available, e.g., from Stauffer Chemical Corporation, as an aqueous solution at a concentration of about 50% by weight. The commercial material is suitable for the practice of this invention.

It is known that ammonium and metal dihydrogen phosphates lose water when heated at about 500° C. for 2–3 hours to form linear polyphosphates of high molecular weight. This is a convenient way to prepare these products, especially the potassium compound. Ammonium, sodium and potassium polyphosphates are soluble (or dispersible) in water provided there is present in solution a small amount of a different alkali cation. For example, potassium polyphosphate can be dissolved by placing it in a solution of an ammonium, sodium or a lithium salt, e.g. about 5–15% by weight lithium sulfate until it swells to form a gel. This gel will then dissolve readily in salt-free water. Potassium polyphosphate can also be dispersed in 5–15% hydrogen peroxide.

Ammonium polyphosphate is commercially available, e.g. from Monsanto Chemical Company, and the usual commercial material is suitable for the practice of this invention.

The orthophosphoric acid used in the practice of this invention is preferably the 85% grade, although less concentrated acid can be used. Phosphoric acid prepared by wet process is preferred to that obtained by oxidation of elemental phosphorous. Wet process acid useful in the practice of this invention is preferably the so-called black acid, but green acid is also a useful acid.

Potassium olivine phosphate useful in the practice of this invention is readily prepared from potassium dihydrogen phosphate and olivine. The two components are well mixed in a ratio of about 0.5-15:1, preferably about 3-1:1 respectively. The mixture is then heated to above about 805° C. for about 30–180 minutes. A molten material thereby obtained crumbles easily, when allowed to stand in moist air (75–90% relative humidity) for several days. For use in the practice of this invention, the potassium olivine phosphate should be comminuted.

The foundry aggregate useful in the practice of this invention can be any known aggregate such as silica sand, zircon, olivine, alumino silicate sand (zeolite), chromite sand and the like. Olivine is a preferred sand. The aggregate should be of a particle size consistent with desired result.

Olivine is a natural mineral consisting of a solid solution rich in magnesium orthosilicate (Fosterite) with a minor amount of ferric orthosilicate (Fayalite). Olivine is a major component of dunite rock. Periodtite is another olivine-bearing rock. Typically, olivine has a composition falling within the following general ranges:

MgO—40–52% by weight $SiO_2$—35-45% by weight
FeO—6.5-10% by weight
$Al_2O_3$, $K_2O$, $Na_2O$—Trace An olivine falling within the above ranges is suitable for the practice of this invention.

The invention will be better understood with reference to the following examples. It is understood, however, that there examples are intended only to illustrate the invention and it is not intended that the invention be limited thereby.

EXAMPLE 1

North Carolina olivine sand, 1500 g, was delivered to a Hobart 50 mixer. To this was added 7.5 g (0.5% by weight) of ammonium polyphosphate powder. These materials were mixed for 2 minutes at low speed. There was then added 45 g of a 50% by weight solution of aluminum dihydrogen phosphate (22.5 g dry basis, or 1.5% by weight of the sand) and the material was mixed on speed setting 2 for two minutes.

The coated sand was then packed into a plurality of "dog bone" shaped molds. Compressive strength was measured every 20 minutes with a Dietert 454B mold strength tester until 2 hours had passed or until a reading of 50 psi was obtained. The cores were then removed from the molds and and allowed to stand overnight. Scratch hardness and tensile strength were then measured. The results obtained are given in the table.

| Example No. | 1 | 2 | 3 |
|---|---|---|---|
| Compressive Strength at | | | |
| 20 minutes | 0 psi | 0 psi | 0 psi |
| 40 minutes | 5 | 7 | 5 |
| 60 minutes | 10 | 7 | 8 |
| 80 minutes | 16 | 18 | 18 |
| 100 minutes | 22 | 26 | 26 |
| 120 minutes | 31 | 38 | 31 |
| Scratch Hardness | 41 | 50 | 48 |
| Tensile Strength | 32 | 44 | 35 |

EXAMPLE 2

The experiment of Example 1 was repeated in all essential details except that additionally 3.75 g of volcanic ash from Mt. St. Helens, State of Washington, was added, equal to 0.25% based on the weight of the olivine. The results are given in the table.

EXAMPLE 3

The experiment of Example 2 was repeated in all essential details except that sodium silicate (which analyzed 5% sodium as sodium oxide) was substituted for volcanic ash. The results are given in the table.

EXAMPLES 4-8

The experiment of Example 1 was repeated in all essential details except that aluminum dihydrogen phosphate (ADP) was used alone and in various combinations as shown in the following table.

| Example Number | ADP | Other | Cure Time | Compressive Strength | Tensile Strength |
|---|---|---|---|---|---|
| 4 | 2.0%* | None | 4 Hrs | 15 psi | 35 psi |
| 5 | 1.5% | 1% Ammonium polyphosphate | 1 Hr | 34 psi | 35 psi |
| 6 | 1.5% | 1% Potassium Polyphosphate | 1 Hr | 35 psi | 22 psi |
| 7 | 0.5% | 1% $H_3PO_4$<br>2% Potassium Olivine Phosphate | 1 Hr | 15 psi | 42 psi |
| 8 | 0.7% | 1.5% $H_3PO_4$<br>1.0% Ammonium Polyphosphate | 2 Hrs | 12 psi | 46 psi |

*Based on weight of sand.

We claim:

1. An improved binder composition for a foundry aggregate comprising aluminum dihydrogen phosphate and a hardener therefor selected from the group consisting of ammonium polyphosphate, potassium polyphosphate, potassium olivine phosphate, volcanic ash, sodium silicate, phosphoric acid and mixtures thereof.

2. The binder composition of claim 1 wherein the hardener is ammonium polyphosphate.

3. The binder composition of claim 1 wherein the hardener is a mixture of ammonium polyphosphate and volcanic ash.

4. The binder combination of claim 1 wherein the hardener is a mixture of ammonium polyphosphate, volcanic ash and sodium silicate.

5. The binder composition of claim 1 wherein the hardener is a mixture of ammonium polyphosphate, volcanic ash, sodium silicate and phosphoric acid.

6. The binder composition of claim 1 wherein the hardener therefor is a mixture of potassium polyphosphate with phosphoric acid.

7. A foundry core or mold prepared by the process of (a) mixing a foundry aggregate with the binder composition of claim 1 and (b) delivering to a core box or mold and allowing to cure.

8. A method for preparing sand cores and molds from a foundry aggregate and a binder therefor comprising the steps of (a) mixing the aggregate with a binder composition of claim 1, (b) delivering the aggregate mixture to a core box or mold, (c) allowing the mixture to cure for a time sufficient to effect suitable compression strength, (d) removing from the core box or mold, and (e) allowing to continue to cure to effect a satisfactory tensile strength.

9. The binder composition of claim 1 wherein the hardener is a mixture of ammonium polyphosphate and sodium silicate.

10. The binder composition of claim 1 wherein the hardener is a mixture of ammonium polyphosphate and phosphoric acid.

* * * * *